US006182397B1

(12) United States Patent
Almond

(10) Patent No.: US 6,182,397 B1
(45) **Date of Patent: *Feb. 6, 2001**

(54) REMOVABLE SECURITY APPARATUS FOR BUILDING OPENINGS WITH QUICK-RELEASE LATCH MECHANISM

(76) Inventor: Gary L. Almond, 3404 Osborne Blvd., Racine, WI (US) 53405

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/050,857

(22) Filed: Mar. 30, 1998

Related U.S. Application Data

(60) Provisional application No. 60/043,913, filed on Apr. 3, 1997.

(51) Int. Cl.[7] ..... E06B 3/68; E06B 9/02

(52) U.S. Cl. ..... 49/57; 49/463

(58) Field of Search ..... 49/465, 464, 463, 49/55, 57, 50, 61, 63

(56) References Cited

U.S. PATENT DOCUMENTS

| | | | | |
|---|---|---|---|---|
| 980,535 | * | 1/1911 | Kleinengger | 49/57 |
| 999,682 | | 8/1911 | Suits et al. . | |
| 1,105,791 | | 8/1914 | Irving . | |
| 1,507,478 | | 9/1924 | Gray . | |
| 1,632,333 | * | 6/1927 | Healy | 49/246 |
| 1,657,908 | | 1/1928 | Wulftange . | |
| 1,730,151 | | 10/1929 | Kemp . | |
| 2,722,722 | | 11/1955 | Mussman . | |
| 3,763,615 | | 10/1973 | Yamazaki . | |
| 3,871,151 | | 3/1975 | Der Estephanian . | |
| 4,038,800 | | 8/1977 | Daley, Jr. . | |
| 4,099,511 | * | 7/1978 | McIntier et al. | 126/190 |
| 4,162,590 | | 7/1979 | Earley . | |
| 4,400,912 | * | 8/1983 | Wicks | 49/57 |
| 4,409,757 | * | 10/1983 | Daugherty | 49/449 |
| 4,416,084 | | 11/1983 | Zen . | |
| 4,475,309 | * | 10/1984 | Porter | 49/55 |
| 4,495,728 | | 1/1985 | Lynn . | |
| 4,587,759 | * | 5/1986 | Gray | 49/50 |
| 4,593,492 | | 6/1986 | Lumenello . | |
| 4,653,226 | | 3/1987 | Woodrow . | |
| 4,685,261 | * | 8/1987 | Seaquist | 52/202 |
| 4,817,334 | * | 4/1989 | Badger et al. | 49/55 |
| 4,848,030 | * | 7/1989 | Bennett | 49/57 |
| 4,881,354 | | 11/1989 | Pitt . | |
| 4,897,961 | | 2/1990 | Shine . | |
| 5,269,096 | | 12/1993 | Hade . | |
| 5,283,975 | * | 2/1994 | Piterski | 49/50 |
| 5,339,567 | | 8/1994 | Pierpont et al. . | |
| 5,392,570 | | 2/1995 | Cowan . | |
| 5,740,628 | | 4/1998 | Almond . | |

* cited by examiner

*Primary Examiner*—Daniel P. Stodola
*Assistant Examiner*—Gregory J. Strimbu
(74) *Attorney, Agent, or Firm*—Jansson, Shupe Bridge & Munger, Ltd.

(57) ABSTRACT

A removable security bar apparatus for preventing ingress through a building opening such as a window or door. The apparatus includes a grille and latch mechanism permitting quick removal of the grille from the building opening in the event of an emergency. The grille is held in place across the opening by a stop member which secures one side of the grille structure to the opening and a latch mechanism. The latch mechanism includes at least one removable rod positioned through a wall mounted bracket and into a fixed rod secured to the grille thereby securing the grille over the building opening. The grille is rapidly removed by sliding the at least one removable rod away from the fixed rod and bracket allowing the grille to be gripped and moved away from the opening.

15 Claims, 3 Drawing Sheets

REMOVABLE SECURITY APPARATUS FOR BUILDING OPENINGS WITH QUICK-RELEASE LATCH MECHANISM

RELATED APPLICATION

This application is based upon U.S. provisional patent application serial no. 60/043,913 filed Apr. 3, 1997.

FIELD OF THE INVENTION

This invention is related generally to moveable and removable closures and, more particularly, to protective grilles for securing building openings.

BACKGROUND OF THE INVENTION

As was pointed out in Applicant's U.S. patent application Ser. No. 08/611,598, now U.S. Pat. No. 5,740,628, crime is serious problem confronting modern society. Burglary and forced entry into buildings are of major concern to families, businesses and organizations. Such crimes can result in theft, property damage, personal injury, or more serious harm.

Security doors and windows are a well known means of preventing criminals from entering a building through a building opening. Security doors and windows typically consist of heavy metal bars or grates that are placed over a window or door opening to prevent criminals from entering the building. These security systems are typically secured to the building opening in a permanent manner (i.e., they are not removable). U.S. Pat. No. 4,162,590 (Earley), U.S. Pat. No. 3,871,151 (Der Estephanian) and U.S. Pat. No. 1,657,908 (Wulftange) are examples of permanently-mounted security bars or grates.

While permanently-mounted security bars may prevent criminals from breaking into a building they also present serious safety concerns for people in the building. For example, security bars may prevent egress in the event of an emergency such as a fire. A person inside the structure who would normally escape the fire by exiting through a basement or ground floor window could find his or her means of egress blocked.

In response to this serious safety problem, others have sought to develop security bars which can be removed in the event of an emergency. U.S. Pat. No. 5,339,567 (Pierpont), U.S. Pat. No. 5,269,096 (Hade), U.S. Pat. No. 4,653,226 (Woodrow), U.S. Pat. No. 1,507,478 (Gray) and U.S. Pat. No. 999,682 (Suits) are all examples of removable security devices.

However, these removable security bar devices all have certain disadvantages. For example, Pierpont, Hade, Gray and Suits each secure their bars with a key-actuated lock located near the window opening. Operation of a lock would be impossible if the key were lost or misplaced. In addition, operation of a lock may be beyond the ability of a person who is panicking in an emergency situation such as a fire or criminal home invasion. Minimally, a person in a state of panic would require excessive time to actuate the lock; such time may not be available in an emergency. It is advantageous for the security bars to be secured in a manner not requiring a lock.

At the same time that security bars can keep criminals out, they can also serve the beneficial purpose of keeping small children and pets in by preventing them from falling out of the window. This is an unfortunate but very real problem in high-rise apartment buildings where families with children and pets are present. While the security bars should be easy for an adult to remove, they should be difficult for a child to remove.

A security system which would prevent ingress through a building window (with or without a locking device) which would be easy for an adult to remove so that people could exit the building in the case of an emergency, yet which would be relatively difficult for a child to remove would represent an important advance in the art.

OBJECTS OF THE INVENTION

It is an object of this invention to provide an improved security apparatus overcoming some of the problems and shortcomings of devices of the prior art.

Another object of this invention is to provide an improved security apparatus which securely covers a window or other building opening thereby preventing ingress to the building.

Yet another object of this invention is to provide an improved security apparatus which remains securely in place without the requirement of a key-actuated lock.

A further object of this invention is to provide an improved security bar apparatus which may be rapidly and easily removed from a window or other building opening facilitating egress from the building.

It is also an object to provide an improved security bar apparatus which is relatively difficult for a small child to remove.

These and other important objects will be apparent from the following descriptions and from the drawings.

SUMMARY OF THE INVENTION

Briefly described, the invention is a removable apparatus for preventing ingress through an opening in a building and which may be removed for egress through the opening by a building occupant. The invention may be removed rapidly by an adult but is relatively difficult for a small child to remove. The invention may be used in many different types of suitable building openings such as bay windows, standard flat window openings and doors.

The invention includes a grille structure removably secured with respect to the opening. The preferred grille structure has an upper horizontal bar member (also referred to herein as a "first horizontal bar member"), at least one lower horizontal bar member (also referred to herein as "second horizontal bar member"), a pair of laterally-disposed vertical members coupled to the horizontal members, and a latch mechanism for limiting lateral and vertical movement of the grille structure. Preferably, the latch mechanism allows rapid removal of the grille structure from the building opening by an adult.

It is preferred that at least one stop member is secured along the bottom of the building opening for receiving at least one of the grille structure vertical members. Preferably, each grille vertical member is received in the stop member.

The preferred stop member has a first stop portion an opposed second stop portion and a space therebetween. The first and second stop portions limit movement of the grille structure to the space between the opposed stop portions. Highly preferred forms of the stop member include at least one channel having first and second vertical walls forming a substantially open top portion through which at least one grille vertical member is received. It is most highly preferred that the stop member consists of a single channel.

The stop member is positioned in an appropriate position for securing the grille structure. By way of example only, the stop member may be positioned within the window opening or along the wall surface adjacent to the window opening.

Preferred forms of the latch mechanism include at least one upper horizontal bar member secured to the grille structure. The upper horizontal bar member has hollow outer ends which are configured to receive a moveable security rod in telescoping relationship. It is highly preferred that the upper horizontal bar member is a hollow tube.

A pair of grille support brackets are provided. The brackets are positionable inside the building—typically on the interior wall surface. Each of the preferred brackets has a hollow security rod-receiving portion positionable in alignment with a respective fixed rod hollow end.

At least one moveable security rod is provided and the at least one rod is slideably positionable within each bracket rod-receiving portion in telescoping relationship thereby interfering with lateral movement of the grille structure. It is most preferred that two security rods are provided. Each rod is positionable within its respective bracket rod-receiving portion and upper horizontal bar member hollow end in a telescoping arrangement.

In one preferred embodiment, each security rod has an outer end and a restraint positioned with respect to each outer end. The restraint abut the brackets and limits the slideable movement of each rod with respect to its respective bracket. The restraint may be fashioned in a decorative pattern such as a fleur-de-lis.

While not required, an opening in the at least one security rod can be provided for receiving a securing device. The opening may be positioned between at least one bracket and one of the laterally-disposed vertical members thereby interfering with sliding movement of the at least one security rod. The securing device can be any suitable device such as a lock.

This advantageous arrangement permits the grille to be positionable against the stop member, removably secured with respect to the opening by the latch mechanism and removable only from inside the building. The preferred position of the security rods (in alignment with the upper horizontal bar member) makes it relatively difficult for a child to remove the security rods.

BRIEF DESCRIPTION OF THE DRAWINGS

FIG. 4(*b*) is a side elevation of the bracket member of FIG. 4(*a*).

FIG. 4(*c*) is a side elevation of an alternative bracket member.

DETAILED DESCRIPTIONS OF THE PREFERRED EMBODIMENTS

This invention involves a burglary prevention apparatus that is mounted over an opening on the inside of a building. Placement of the apparatus inside not only makes it impossible for an intruder to tamper with the device, it also protects the apparatus from the elements thus preventing rust or other wear from degrading the protection offered by the invention.

Figure 1:
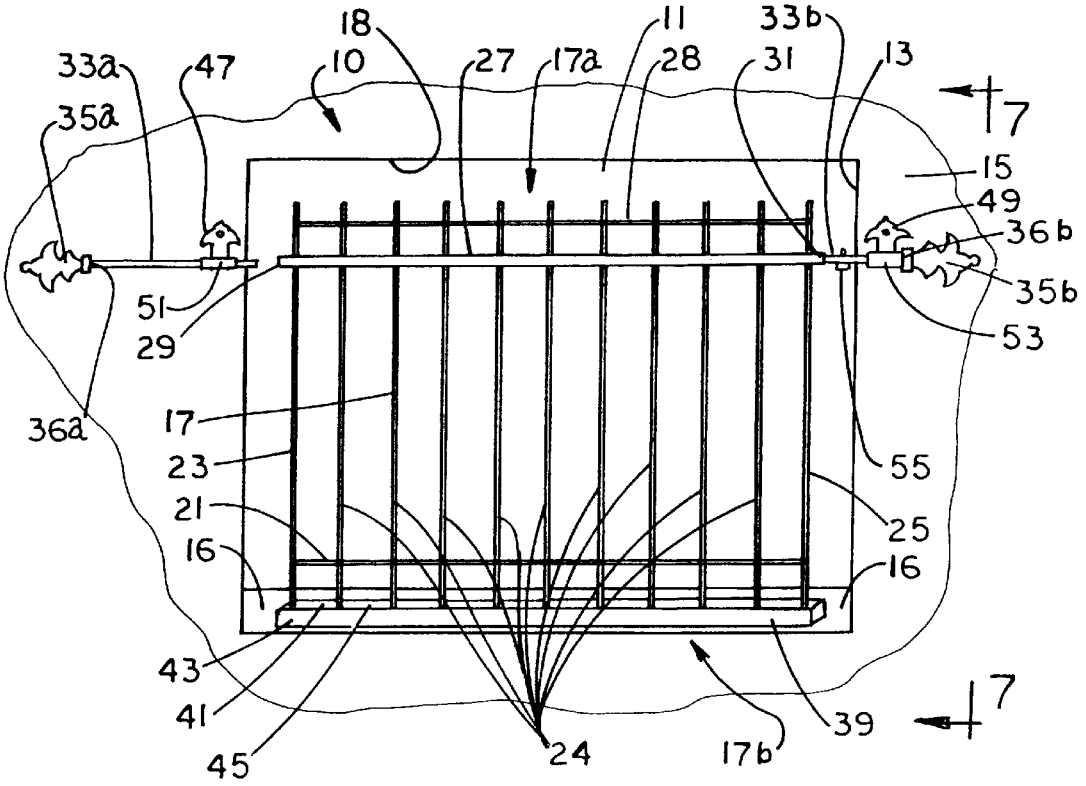
FIG. 1 is a front elevation of the invention showing a grille mounted over a window opening.
Figure 2:
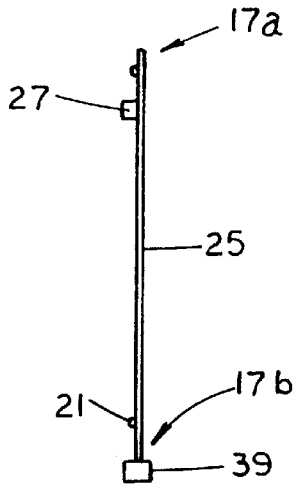
FIG. 2 is side elevation of the invention showing the grille positioned with respect to one form of a stop member.
Figure 8:
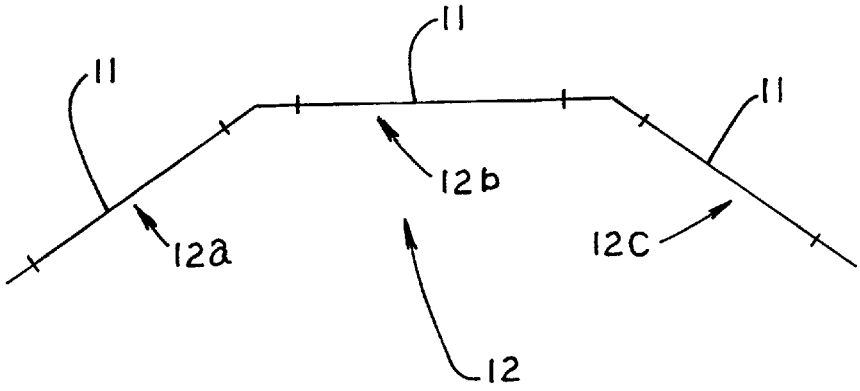
FIG. 8 is a top view of an exemplary bay window showing potential grille mounting positions.

FIG. 1 shows one embodiment of Applicant's inventive security apparatus 10 positioned inside a building opening typical of a home or business. Apparatus 10 is intended to prevent burglars and the like from gaining unauthorized entry to a building through window 11 secured in building opening 13. In the example shown, opening 13 is positioned in the inner wall surface 15 and the outer wall surface 15*a*. Opening 13 includes sill 16 and top surface 18. FIG. 8 shows an exemplary bay window 12 including potential mounting positions 12*a*, 12*b*, 12*c* for the apparatus 10. The invention is not limited to use with these specific types of openings.

The invention includes a grille structure 17 removably secured with respect to opening 13. Grille 17 is positioned inside the building. Grille 17 has an upper horizontal bar member 27 at least one lower horizontal bar member 21 and a pair of laterally-disposed vertical members 23 and 25 coupled to the horizontal members 27 and 21. Preferably, a plurality of vertical members 24 are provided on grille 17. Grille structure 17 includes upper 17*a* and lower 17*b* ends.

The grille structure 17 includes at least one upper horizontal member 27 which is secured to the grille structure 17. The upper horizontal member 27 has hollow outer ends 29 and 31 each for receiving a moveable security rod 33 in a sliding or telescoping manner. Additonal horizontal bar member 28 secured to grille structure 17 may be provided. It is highly preferred that upper horizontal member 27 is a hollow tube.

Figure 6:
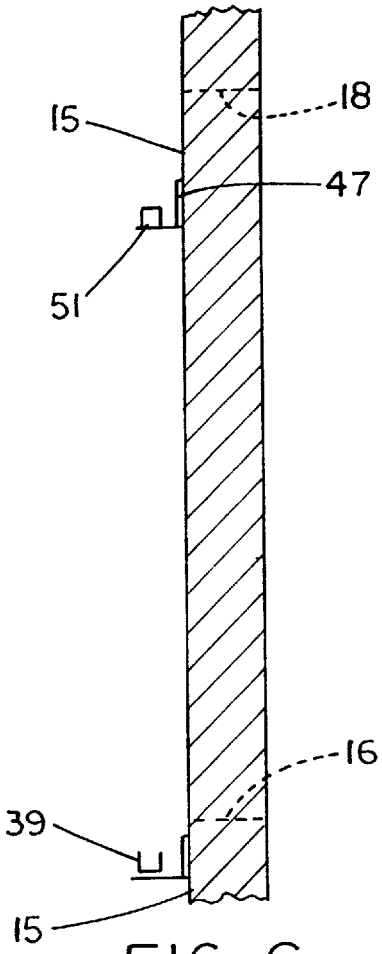
FIG. 6 is cross sectional elevation showing a potential mounting position for the brackets and stop member.
Figure 7:
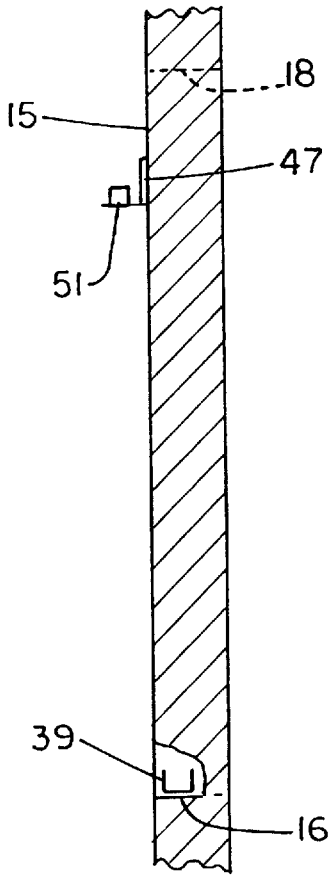
FIG. 7 is cross sectional elevation taken through section 7—7 of FIG. 1 showing another potential mounting position for the brackets and stop member.

As shown in FIGS. 1 and 7, a stop member 39 is preferably secured along sill 16 by suitable fasteners (not shown). The stop member 39 is positioned to receive at least one, and preferably all, of the vertical members 23, 24, 25. When installed using the bracket 47 and stop member 39 positioning shown in FIGS. 1 and 7 the grille structure 17 would be positioned over the building opening 13 at a slight angle relative to a vertical plane. However, and as shown in FIG. 6, stop member 39 can also be placed against wall surface 15.

Figure 5:
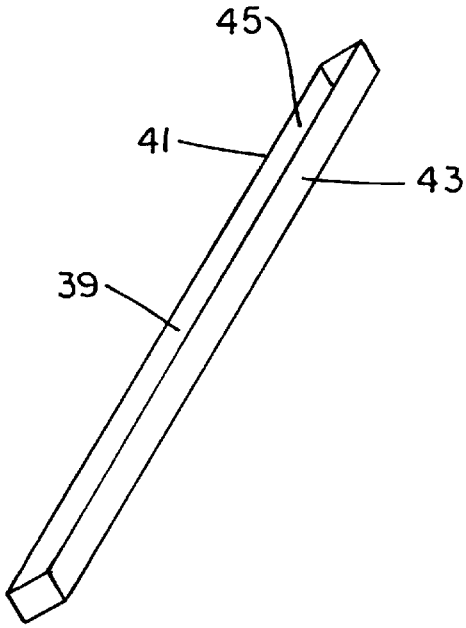
FIG. 5 is a perspective view of an exemplary stop member.

As shown in FIGS. 1, 5 and 6, stop member 39 has a first stop portion 41 and an opposed second stop portion 43. The purpose of the first and second stop portions 41 and 43 is to limit movement of the grille structure 17 to the space 40 between the opposed stop portions 41 and 43 when vertical members 23, 24, 25 are positioned against stop member 39. The preferred stop member 39 shown in FIGS. 1, 5 and 6 is a one-piece channel 39 and the first and second stop members 41 and 43 are vertical walls formed in stop member 39. The vertical walls 41 and 43 form a substantially open top portion 45 through which at least one grille vertical member 23, 24, 25 is received.

Stop member 39 is not limited to the preferred channel structure. Virtually any structure which restricts movement of the grille structure 17 vertical members 23, 24, 25 will suffice for use as the stop member 39. Thus, by way of example only, the stop member 39 could comprise a plurality of channels (not shown).

Referring next to FIGS. 1, 4, 4*a*, 6 and 7, a pair of grille support brackets 47 and 49 are provided to secure the grille structure 17 to the building wall surface 15. Brackets 47 and 49 are positionable inside the building and are held in place by suitable fasteners (not shown). Each bracket 47 and 49 has a hollow security rod-receiving portion 51 and 53 positionable in alignment with a respective upper horizontal member 27 hollow end 29 or 31. As shown by the different bracket embodiments 47 or 49 in FIGS. 4 and 4*a*, the structure of the brackets 47 or 49 can vary depending on the application and can, of course, include ornamental structure.

At least one moveable security rod 33 (FIG. 3) is provided to secure the grille structure 17 to the brackets 47 and 49 thereby limiting vertical and lateral grille 17 movement and securing grille structure 17 over opening 13. It is highly preferred that the moveable security rod 33 actually comprise two separate rods 33*a* and 33*b* as shown in FIG. 1. The preferred moveable security rods 33*a* and 33*b* are slideably positionable within each respective bracket rod-receiving portion 51 or 53 and each respective upper horizontal member 27 hollow end 29 or 31 in telescoping relationship thereby interfering with movement of the grille structure 17. Each security rod 33, 33*a* or 33*b* preferably includes a restraint 36*a*, 36*b* positioned with respect to one rod outer end 35*a*, 35*b* for limiting the slideable movement of each security rod 33, 33*a*, 33*b* with respect to its respective bracket 47 or 49.

Figure 3:
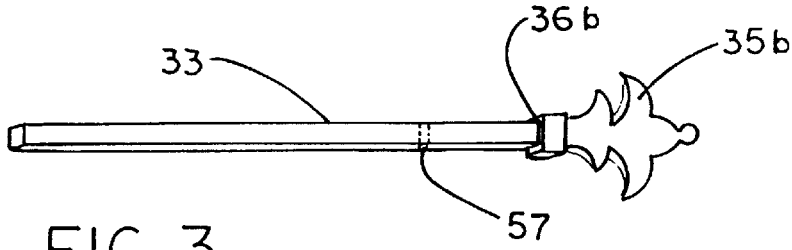
FIG. 3 is a perspective view of an exemplary security rod of the invention.
Figure 4A:
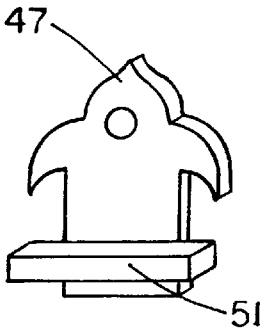
FIG. 4(*a*) is a perspective view of exemplary bracket member.
Figure 4B:
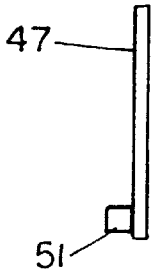
Figure 4C:
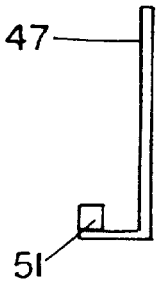

In certain embodiments a securing device 55 (FIG. 1) could optionally be provided to further restrict movement of the security rods 33, 33*a* or 33*b*. As shown in FIG. 3, in these embodiments, an opening 57 for receiving a securing device, such as lock 55, is formed in security rod 33, 33*a* or 33*b*. The securing device 55 need not be a lock and could be some other suitable device, such as a D-ring inserted through opening 57, which would interfere with movement of security rod 33, 33*a* or 33*b*. Preferably, opening 57 is positioned between at least one bracket 47 or 49 and the respective laterally-disposed vertical member 23 or 25 thereby interfering with sliding movement of security rod 33, 33*a*, 33*b*.

In use, grill structure 17 is removably supported with respect to opening 13 by the security rod 33 or rods 33*a* and 33*b* and by the stop member 39. To mount the grille structure 17 over the opening 13, at least one vertical member 23, 24, 25 is placed in stop member 39 and grille 17 is positioned so that the fixed rod hollow ends 29 and 31 are in alignment with bracket hollow rod receiving portions 51 and 53. Next, security rod 33 or rods 33*a*, 33*b* are inserted through the respective brackets 47 or 49 and into upper horizontal member 27 via the respective hollow ends 29 or 31.

In this way the grille structure 17 is removeably secured to the opening 13. Movement of the grille structure 17 is limited along the bottom of the grille 17 by interference with first and second stop members 41 and 43. Lateral and vertical movement of the grille structure 17 is restricted by security rod 33 or rods 33*a* and 33*b* positioned through brackets 47, 49 and fixed rod 27. A burglar would have a difficult time removing grille 17 because the criminal would be required to reach far into opening 13 to remove security rod 33 or 33*a*, 33*b*. Forced entry could be made more difficult by elongating the upper horizontal member 27 at each end thereby forming a type of burglar-proof sheath over rod 33 or 33*a*, 33*b* and by moving the brackets 47 and 49 further from the opening 13. An optional locking device 55 attached to at least one security rod 33 would further complicate removal of the grille structure 17. At the same time, a small child would have difficulty removing grille 17 because the small child would lack the reach and dexterity to remove the security rod 33 or rods 33*a*, 33*b*.

The grille structures 17 of the invention are sized to the particular building opening 13 such as the exemplary bay window 12 represented by FIG. 8. Materials useful in making the grille structure 17 and related parts will be known to those of skill in the art. Wrought iron is believed to be a preferred material for use in making the grille structure 17 and rods 27, 33 because of its strength and ease of use. Similarly, there are no particular restrictions as to the shape of the bars and rods. For example, rectangular-shaped materials are just as suitable as rounded materials.

While the principles of this invention have been described in connection with specific embodiments, it should be understood clearly that these descriptions are made only by way of example and are not intended to limit the scope of the invention.

What is claimed:

1. A removable apparatus for preventing ingress through a building opening in a building, the apparatus comprising:

a grille structure configured to be removably secured across the opening and in a spaced-apart relationship from a closure positioned across the opening, the grille structure having an upper horizontal bar member including opposed first and second ends each having a bore therein, at least one lower horizonal bar member, and plurality of laterally-spaced vertical members coupled to the horizontal members;

at least one stop member configured to be secured along a building surface within the building adjacent to the building opening, the stop member having a first stop portion and an opposed second stop portion and a space therebetween, the first and second stop portions limiting movement of at least one of the grille structure vertical members to the space between the opposed stop portions; and a latch mechanism comprising at least one support bracket configured to be positionable along the building surface within the building, the bracket having a hollow security rod-receiving portion positionable in alignment with said bore of said first end of said upper horizontal bar member, and a moveable security rod slidably positionable within said rod-receiving portion and within said bore of said first end of said upper horizontal bar member in a telescoping relationship, wherein when said security rod is in a first position, the grille structure is moveable with respect to said latch mechanism and when said security rod is in a second position disposed within said bore of said first end of said upper horizontal bar member, said grille structure is prevented from moving with respect to said latch mechanism.

2. The apparatus of claim 1 wherein the stop member comprises at least one channel having a substantially open top portion through which said at least one of the grille structure vertical members is received and said first and second stop portions comprise first and second vertical walls, respectively, of said at least one channel.

3. The apparatus of claim 1 wherein the stop member comprises a single channel having a substantially open top portion through which said grille structure vertical members are received and said first and second stop portions comprise first and second vertical walls, respectively, of said single channel.

4. The apparatus of claim 1 wherein the upper horizontal bar member is a hollow tube.

5. The apparatus of claim 1 further comprising a second support bracket having a hollow security rod-receiving portion positionable in alignment with said bore of said second end of said upper horizontal bar member and further comprising a second moveable security rod slidably positionable within said hollow security rod-receiving portion of said second support bracket and said bore of said second end of said upper horizontal bar member in a telescoping relationship.

6. The apparatus of claim 5 wherein each security rod has an outer end and a restraint positioned with respect to said outer end for limiting slideable movement of each rod with respect to said bracket.

7. The apparatus of claim 1 wherein the grille structure further includes an upper end and at least a third horizonatal bar member attached to the grille structure.

8. The apparatus of claim 1 wherein the security rod includes an opening for receiving a securing device, the opening positioned between said at least one support bracket and one of the laterally-spaced vertical members when said security rod is in said second position thereby interfering with sliding movement of the security rod.

9. The apparatus of claim 8 wherein the securing device is a lock.

10. A removable apparatus for preventing ingress through a building opening in a building, the apparatus comprising:

a grille structure configured to be removably secured across the opening and in a spaced-apart relationship from a closure positioned across the opening, the grille structure having a first horizontal bar member including opposed first and second ends each having a bore therein, at least a second horizonal bar member spaced apart from the first horizontal bar member, and a plurality of laterally-spaced vertical members coupled to the horizontal members;

at least one stop member configured to be secured along a building surface within the building adjacent to the building opening, the stop member having a pair of spaced apart restraint surfaces limiting movement of at least one of the grille structure vertical members to the space between the restraint surfaces; and a latch mechanism comprising at least one support bracket configured to be positionable along the building surface within the building, the bracket having a hollow security rod-receiving portion positionable in alignment with said bore of said first end of said first horizontal bar member, and a moveable security rod slidably positionable within said rod-receiving portion and within said bore of said first end of said first horizontal bar member in a telescoping relationship, wherein when said security rod is in a first position, the grille structure is moveable with respect to said latch mechanism and when said security rod is in a second position disposed within said bore of said first end of said first horizontal bar member, said grille structure is prevented from moving with respect to said latch mechanism.

11. The apparatus of claim 10 wherein the stop member comprises a one-piece channel and the restraint surfaces comprise vertical walls forming a portion of said one-piece channel.

12. The apparatus of claim 10 wherein the first horizontal member is a hollow tube.

13. The apparatus of claim 10 further comprising a second support bracket having a hollow security rod-receiving portion positionable in alignment with said bore of said second end of said first horizontal bar member and further comprising a second moveable security rod slidably positionable within said hollow security rod-receiving portion of said second support bracket and said bore of said second end of said first horizontal bar member in a telescoping relationship.

14. The apparatus of claim 13 wherein each security rod has an outer end and a restraint positioned with respect to said outer end for limiting slideable movement of each rod with respect to said bracket.

15. The apparatus of claim 10 wherein the grille structure further includes an upper end and at least a third horizontal bar member attached to the grille structure.

* * * * *